US008011480B2

(12) United States Patent
Fischer

(10) Patent No.: US 8,011,480 B2
(45) Date of Patent: Sep. 6, 2011

(54) LOAD SENSOR APPARATUS AND METHOD FOR AN ELEVATOR CAR

(75) Inventor: Daniel Fischer, Villarsel-sur-Marly (CH)

(73) Assignee: Inventio AG, Hergiswil NW (CH)

( * ) Notice: Subject to any disclaimer, the term of this patent is extended or adjusted under 35 U.S.C. 154(b) by 687 days.

(21) Appl. No.: 12/114,161

(22) Filed: May 2, 2008

(65) Prior Publication Data

US 2008/0271954 A1 Nov. 6, 2008

(30) Foreign Application Priority Data

May 3, 2007 (EP) ..... 07107468

(51) Int. Cl.
*B66B 1/34* (2006.01)

(52) U.S. Cl. ..... 187/393; 187/281

(58) Field of Classification Search ..... 187/247, 187/286, 302, 391–393, 281
See application file for complete search history.

(56) References Cited

U.S. PATENT DOCUMENTS 4,516,116 A * 5/1985 White ..... 340/685
5,180,185 A * 1/1993 Eckert ..... 280/86.5
6,305,503 B1 * 10/2001 Suzuki et al. ..... 187/393
6,443,266 B2 * 9/2002 Murakami et al. ..... 187/401
6,488,128 B1 * 12/2002 Slabinski ..... 187/393
6,715,587 B2 * 4/2004 Sittler et al. ..... 187/401
7,007,561 B1 * 3/2006 Otto et al. ..... 73/862.631
7,784,589 B2 * 8/2010 Fischer ..... 187/393

FOREIGN PATENT DOCUMENTS

DE 202 21 212 U1 8/2005
EP 0 953 537 A2 11/1999
FR 2 823 734 A 10/2002
WO 01/83350 A1 11/2001

* cited by examiner

*Primary Examiner* — Jonathan Salata
(74) *Attorney, Agent, or Firm* — Fraser Clemens Martin & Miller LLC; William J. Clemens

(57) ABSTRACT

An elevator installation and a method for arranging a load sensor in the elevator installation includes a car, a support device for supporting the car, the load sensor and a deflecting roller unit. The deflecting roller unit is arranged at the car and has at least two deflecting rollers which are rotatable about a common axle. The load sensor is arranged on the common axle between the two deflecting rollers.

13 Claims, 5 Drawing Sheets

A-A

B-B

LOAD SENSOR APPARATUS AND METHOD FOR AN ELEVATOR CAR

FIELD OF THE INVENTION

The present invention relates to an elevator installation comprising a car, a support means for supporting the car and a load sensor, and to a deflecting roller unit for an elevator installation and a method of arranging a load sensor in an elevator installation.

BACKGROUND OF THE INVENTION

The elevator installation is installed in a shaft. It substantially consists of a car connected with a drive by way of support means. The car is moved along a car travel path by means of the drive. The support means are connected with the car by way of deflecting rollers with a multiple slinging. The load-bearing force acting in the support means is reduced by the multiple slinging in correspondence with a slinging factor. The car is designed to transport a useful load which can vary according to the respective need between empty (0%) and full (100%).

An elevator suspension of that kind with a car and a deflecting roller arrangement, which is mounted at the car frame, is known from German patent DE 20 221 212, wherein the deflecting roller arrangement comprises at least two deflecting rollers which are rotatable about a common axle.

A further elevator installation of that kind with two deflecting rollers arranged in parallel is known from European patent EP 1 446 348, wherein the deflecting rollers are arranged symmetrically with respect to a car guide.

Elevator installations of that kind usually include a load measuring system which, for example, is to detect an overload in the car or which measures an effective useful load so as thus to be able to preset a required drive torque for the drive. An overload exists when the useful load is more than 100% of the useful load or which the car is designed. In many cases load measuring systems of that kind are arranged in a car floor, in that, for example, deformations or spring deflections of the car floor are measured, or stress measuring elements are mounted at load-bearing structures of the car.

Proceeding from the known state of the art the object now arises of demonstrating a load measuring system for an elevator installation with deflecting rollers arranged in parallel, the system being able to be integrated simply and favorably in cost in an elevator installation and being capable of measuring the useful load of the car with sufficient accuracy. Moreover, use shall advantageously be able to be made of economic measuring elements.

SUMMARY OF THE INVENTION

The present invention the object of integrating a load measuring system in simple and economic manner in an elevator installation and it is demonstrated how accurate yet economic measuring elements can be used.

According to the present invention a load sensor is now arranged on the common axle between the two deflecting rollers. In this connection it is advantageous that a force acting on the respective common axle can be detected in simple and economic manner by only one load sensor. The force acting on the common axle very satisfactorily represents changes in a car useful load. An arrangement of that kind of the load sensor can be integrated in simple manner in an elevator installation.

Advantageously, in this connection a single load sensor is arranged centrally between the two deflecting rollers and the load sensor measures a bending deformation of the common axle. The central arrangement allows very accurate measurement, wherein a different load distribution to the deflecting rollers at the two sides has virtually no effect on the measurement result. This means that even in the case of an asymmetrical load distribution an accurate measurement is possible by merely one load sensor. The bending deformation of the common axle can be measured in simple manner, since it is an easily determinable load situation, i.e. bending beam on two supports. In an advantageous embodiment the common axle is cut away in the central region, wherein a rectangular cross-section oriented substantially symmetrically with respect to the longitudinal axis of the common axle is left and this cross-section is oriented in such a manner that a resultant deflecting roller force produced by the looping around of the deflecting rollers by way of the support means produces an appropriate bending deformation. An appropriate bending deformation is in this connection a deformation which is satisfactorily matched to a measurement range of the load sensor and it obviously takes into consideration the material characteristics—such as permissible stress, etc.—of the common axle.

Alternatively, the common axle consists of two outer axle sections fixedly connected together by way of a connecting part, wherein this connecting part is in turn shaped and oriented in such a manner that a resultant deflecting roller force caused by the looping around of the deflecting rollers by way of the support means produces an appropriate bending deformation. It is possible by means of this solution to, for example, realize different dispositions or different deflecting roller spacings in a simple manner, since it is merely necessary to change the connecting part.

In both embodiments it is advantageous that an ideal measuring precondition for the load sensor can be realized.

In a further advantageous development the common axle is fastened at its two ends to the car in substantially bending-elastic manner, wherein at least one of the ends has a positioning aid enabling alignment of the common axle with respect to the resultant deflecting roller force. With this embodiment a precise measurement is made possible and incorrect mounting is precluded.

Advantageously, the two deflecting rollers and the common axle, if need be together with support structures for fastening to the car, are assembled in a factory to form a deflecting roller unit. Costly mounting time for the elevator installation is thus reduced and incorrect combinations are precluded, since the complete deflecting roller unit can be subjected to an inspection at the factory. The deflecting roller units can obviously also already be attached to or installed in a structure of the car at the factory.

The elevator installation may comprise two deflecting roller units which are each looped around by, for example, 90°, wherein in this connection at least one of the deflecting roller units includes a load sensor. This is advantageous with regard to cost.

An integration in a control of the elevator installation is advantageously carried out in that the load sensor includes a load measurement computer or is connected with a load measurement computer and this load measurement computer determines an effective useful load with use of a load characteristic of the load sensor. This is advantageous, since the load measurement computer can be furnished with a precise characteristic of the respective load sensor. Thus, several load sensors can also be connected together in simple manner. The load measurement computer can also easily carry out a check of the load sensor in that, for example, an empty weight of the elevator car is used as check magnitude.

In a practical embodiment the load measurement computer detects the effective useful load at intervals during the time period over which access to the elevator car is possible, i.e. when a car door is opened, and an elevator control passes on a respective last measurement signal for determination of a start torque to the elevator drive. This allows determination of a precise start torque, whereby a start-up jolt is largely avoided. In addition, the elevator control can block a move-off command if an overload is detected.

In this solution it is particularly advantageous that the effective useful load is constantly measured, for example every 500 milliseconds, from a point in time when the elevator car can be left and entered, for example when the elevator car has freed an open passage of 0.4 meters, to a point in time when the elevator car can no longer be entered or left, i.e. the car door is virtually closed. The drive thereby constantly has information available about which drive moment it would have to provide at that instant and on the other hand an overload can be recognized in good time. Specifically, it is thus possible, for example, to actuate a warning buzzer before reaching an overload or if necessary to close the car door.

In an advantageous embodiment the load sensor is a digital sensor such as described in, for example, European patent EP 1 044 356. This is advantageous, since a sensor of that kind can be evaluated in simple manner. In a correspondingly realized example the digital sensor changes an oscillation frequency as a consequence of its load, which results from, for example, stretching of an outer tension fiber of the common axle. This oscillation frequency is counted by a computer in each instance over a fixedly defined measuring time period of, for example, 250 milliseconds. The oscillation frequency of the digital sensor is thus a measure for the load or for the useful load disposed in the elevator car. The characteristic of the digital sensor is learned during an initialization of the elevator installation in that, for example, the oscillation frequency of the digital sensor with empty car and with a known test useful load is determined. Thereafter, an associated useful load can be calculated from every further oscillation frequency.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1A:
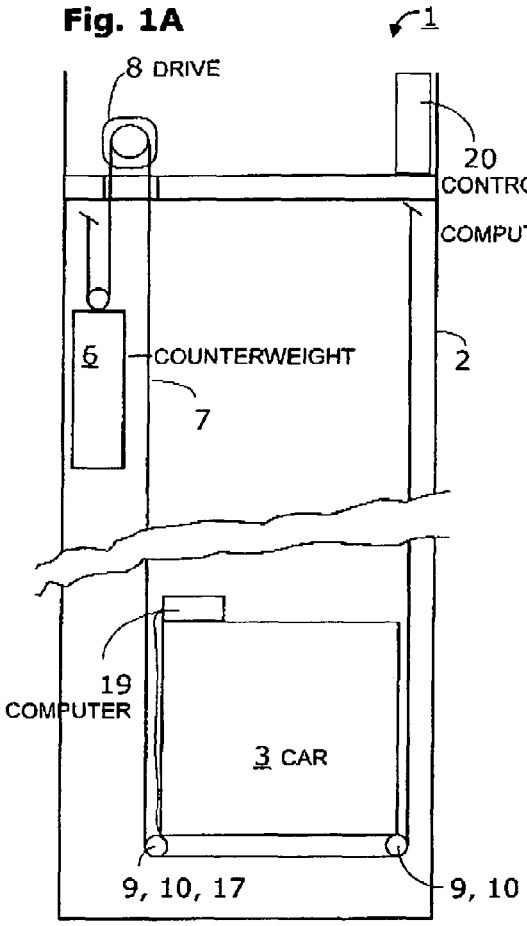
FIG. 1A shows a schematic elevation of an elevator installation with deflecting rollers arranged below the car.
Figure 1B:
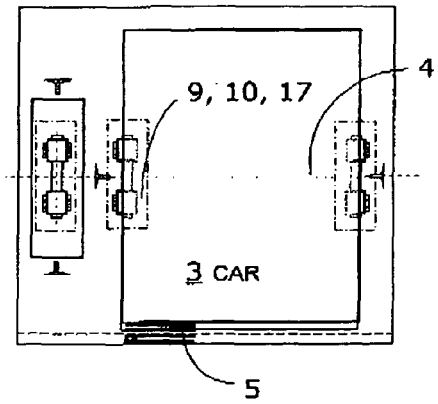
FIG. 1B shows a schematic plan view of an elevator installation corresponding with FIG. 1A.

A first possible overall arrangement of an elevator installation according to the present invention is illustrated in FIGS. 1A and 1B. The elevator installation 1 in the illustrated example is installed in a shaft 2. It consists substantially of a car 3 connected by way of support devices or means with a drive 8 and, further, with a counterweight 6. The car 3 is moved along a car travel path 4 by means of the drive 8. Car 3 and counterweight 6 in that case move in respectively opposite directions. The support devices or means 7 are connected with the car 3 and the counterweight 6 by way of deflecting rollers 9 with a multiple slinging. Two support means 7 are arranged symmetrically with respect to the car travel path 4 and guided through below the car 3 by way of two deflecting roller units 10 each including two deflecting rollers 9. The deflecting rollers 9 of the car 3 are in that case each looped around by 90°. By virtue of the multiple slinging the load-bearing force acting in the support means 7 is reduced in correspondence with a slinging factor, in the illustrated example in correspondence with a slinging factor of two. The illustrated car 3 is disposed in a loading zone, i.e. a car door 5 is opened and an access to the car 3 is correspondingly free.

One of the deflecting roller units 10 of the car 3 is provided with a digital load sensor 17, the signal of which is now constantly conducted to a load measurement computer 19 during the loading process. The load measurement computer 19 performs the required evaluation and passes on the calculated signals or a calculated effective useful load to an elevator control 20. The elevator control 20 passes on the effective measured useful load to the drive 8, which can provide a corresponding start torque, or the elevator control 20 initializes required measures when an overload is detected. Communication of signals from the load measurement computer 19 to the elevator control 20 is carried out by way of known transmission paths such as hanging cable, bus system or wireless. In the illustrated example the load measurement computer 19 and elevator control 20 are separate units. These subassemblies can obviously be combined as desired, thus the load measurement computer 19 can be integrated in the deflecting roller unit 10 or it can be integrated in the elevator control 20 and the elevator control 20 can in turn be arranged at the car 3 or in an engine room or it can also be integrated in the drive 8.

Figure 2A:
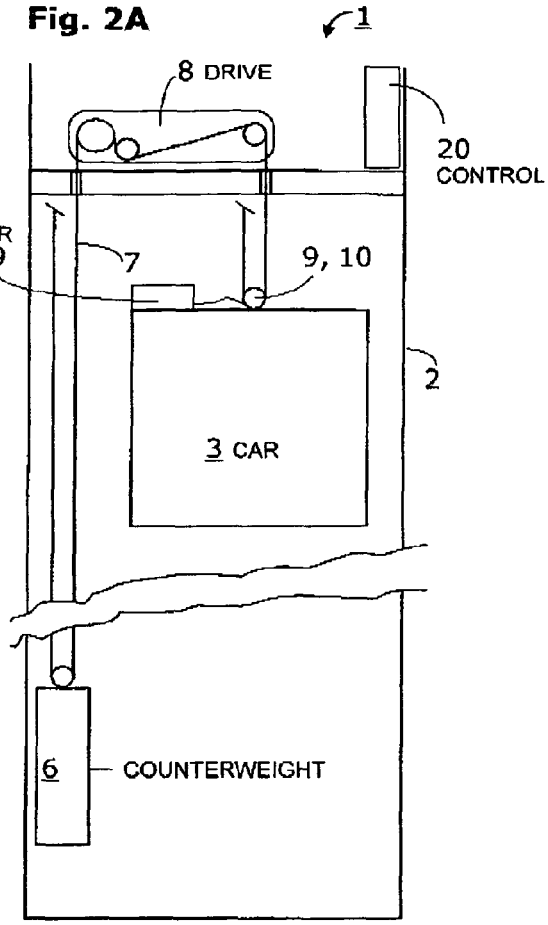
FIG. 2A shows a schematic elevation of an elevator installation with deflecting rollers arranged above the car.
Figure 2B:
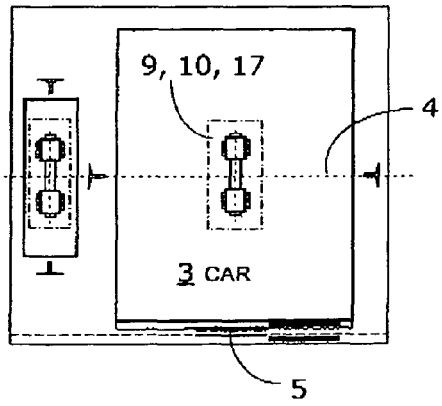
FIG. 2B shows a schematic plan view of an elevator installation corresponding with FIG. 2A.

A further overall arrangement of the elevator installation, which is also executed with a looping factor of two, is illustrated in FIGS. 2A and 2B. By contrast to the preceding embodiment, the deflecting roller 10 is arranged above the car 3. The deflecting rollers 9 of the car 3 are looped around by the support means 7 by 180°, i.e. the support means 7 runs from above to the deflecting roller unit 10, is deflected through 180° and runs again upwardly. The load sensor 17 is installed at the deflecting roller unit 10 at the car side. Moreover, reference is made to the embodiments of FIGS. 1A and 1B. By contrast to FIG. 1B, in FIG. 2B the car door 5 is illustrated closed. In this state the load measurement computer 19 is inactive, since no exchange of useful load is possible. Obviously, the load measurement computer 19 could if required be switched to be permanently active if, for example, conclusions with respect to acceleration processes or disturbances in the travel sequence are to be collated.

Figure 3:
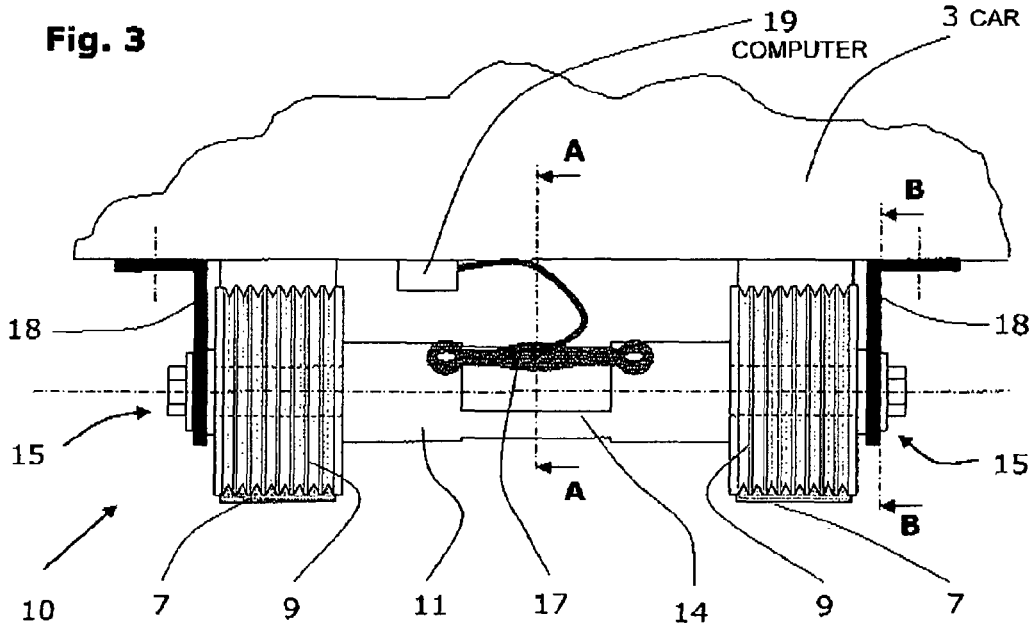
FIG. 3 is a basic illustration of a first deflecting roller unit according to the present invention.
Figure 3A:
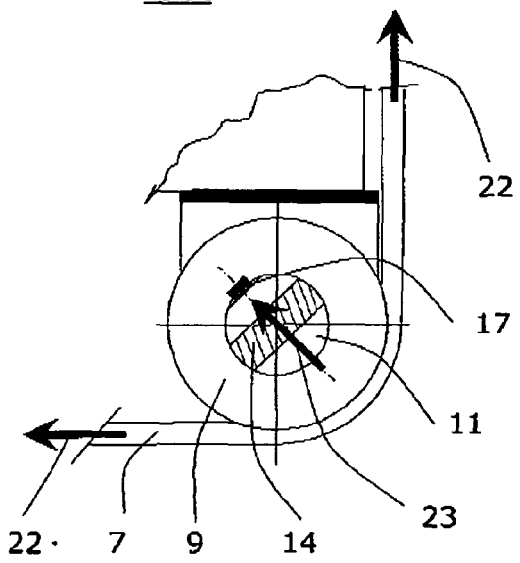
FIG. 3A is a sectional illustration of the deflecting roller unit with load sensor along the line A-A in FIG. 3.
Figure 3B:
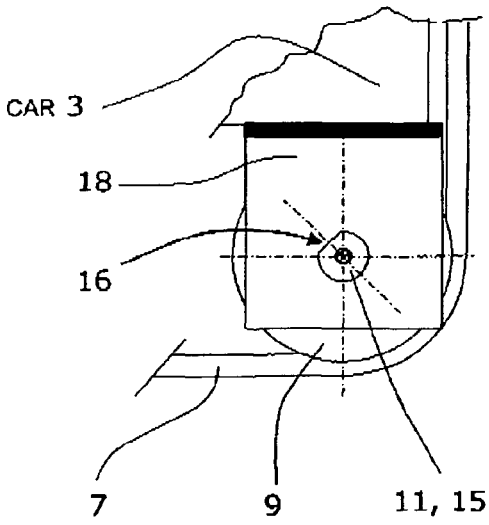
FIG. 3B is a sectional illustration of the deflecting roller unit with positioning aid along the line B-B in FIG. 3.
Figure 3C:
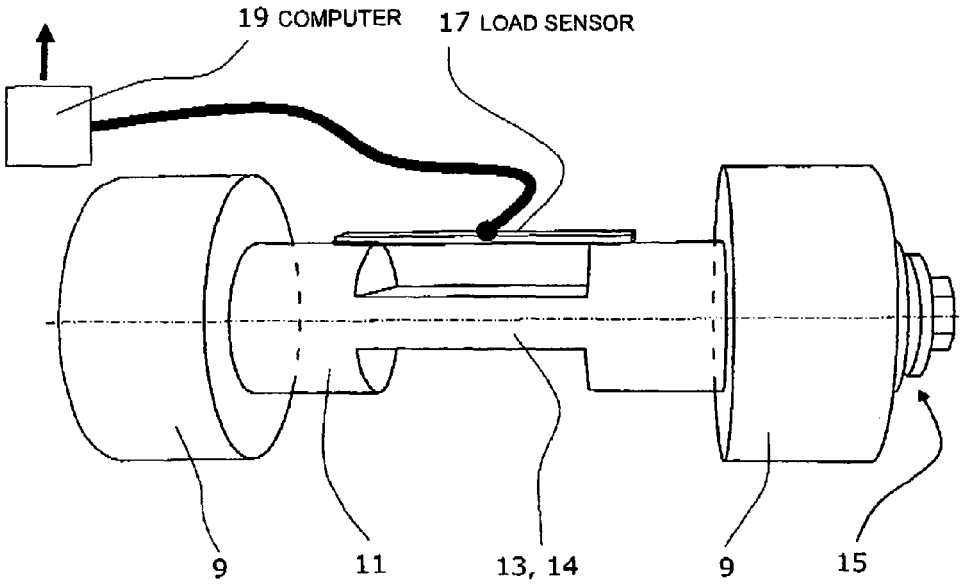
FIG. 3C is a schematic perspective view of the deflecting roller unit according to FIG. 3.

A possible deflecting roller unit 10 such as is usable in the elevator installation 1 according to FIGS. 1A and 1B is illustrated in FIG. 3. The deflecting roller unit 10 comprises a common axle 11 with two deflecting rollers 9 rotatably mounted in the region of the outer ends 15 of the axle 11. The common axle 11 is, in the example, connected with the car 3 by means of supports 18. The axle 11 is in this connection fastened fixedly, at least non-rotatably, to the supports 18. The support 18 in the example is formed from shaped steel plate and it defines for the common axle 11 a support point or support which retains the axle 11 approximately free of bending or in bending-elastic manner. In addition, this fastening is effected in such a manner that the free rotatability of the deflecting rollers 9 themselves is guaranteed. The two deflecting rollers have a spacing from one another which enables, for example, an arrangement of car guides 4 in the region between the two deflecting rollers, as apparent in FIG. 1B. The load sensor 17 is arranged in the center between the two deflecting rollers 9. In the center means that the deflecting rollers 9 and the fastening to the supports 18 are substantially symmetrical with respect to this center. The common axle 11 is reduced in cross-section or cut away in a central region, as illustrated in FIG. 3B. A rectangular cross-section portion 14 oriented substantially symmetrically with respect to the longitudinal axis of the common axle 11 remains. This cross-section portion 14 is oriented in such a manner that a resultant deflecting roller force 23 produced by the looping around of the deflecting rollers 9 by way of the support means 7, or a support means force 22, produces a proportionate bending deformation. In the arrangement selected in accordance with FIGS. 1A and 1B the support means 7 are led through below the car. As a result, the individual deflecting roller unit 10 is, as apparent from FIG. 3B, looped around by 90°. The resulting deflecting roller force 23 is correspondingly turned through 45° relative to the support means forces 22 and the rectangular cross-section portion 14 is oriented in correspondence with the direction of this resultant deflecting roller force 23, so that an optimal bending deformation results. In the indicated example the rectangular cross-section portion 14 or cut-out is selected in such a manner that the load sensor 17 experiences a length change of approximately 0.2 millimeters over the anticipated load or useful load range. The load range in this connection results from the difference between empty and fully laden car 3. As further apparent in FIG. 3B one end 15 of the common axle 11 can be provided with a positioning aid 16 which enables an unequivocal orientation of the common axle 11 with respect to the supports 18 and additionally with respect to the car 3. In the example, the end 15 of the common axle 11 is for that purpose provided with a mechanically positively coupling shape 16 which defines the position of the assembly. FIG. 3C shows in a perspective view the arrangement according to the present invention of the load sensor 17 as described in FIG. 3. The load sensor 17 is as a rule connected with the load measurement computer 19 by means of cable. In the example the load measurement computer 19 is arranged at the car 3. In many cases the load measurement computer 19 can be arranged directly at or integrated directly in the load sensor 17.

Figure 4:
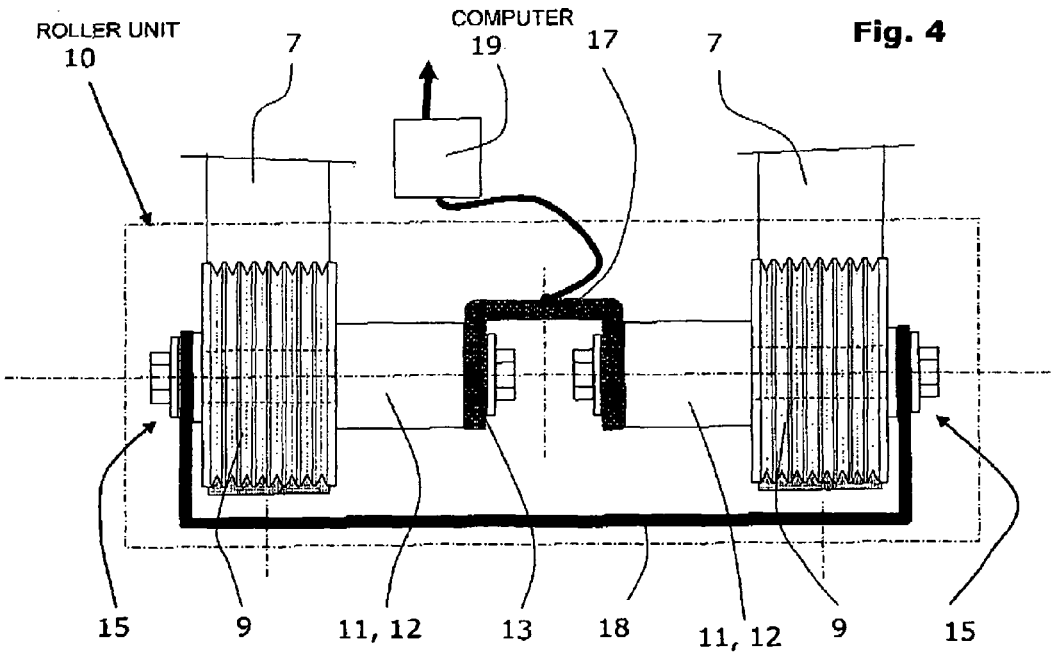
FIG. 4 shows a basic illustration of a further deflecting roller unit according to the present invention.

FIG. 4 shows an alternative embodiment of the deflecting roller unit 10. In this example the common axle 11 is divided into two outer axle sections 12, which form the mount for the deflecting rollers 9 and at the same time enable connection with the support 18. The two outer axle sections 12 are joined together by way of a connecting part 13 to form the complete common axle 11. The connecting part 13 includes the load sensor 17 and is again shaped in such a manner that the optimal loading or bending conditions for the load sensor 17 result. Obviously the connecting locations of the axle sections 12 to the connecting part 13 and to the support 18 are also executed in this form of embodiment in such a manner that an orientation of the common axle 11 in correspondence with a load direction necessarily takes place.

The illustrated embodiments are by way of example and can be changed with knowledge of the invention. Thus, obviously also several deflecting rollers can be used instead of two spaced-apart deflecting rollers 9, wherein, for example, four deflecting rollers would be arranged in pairs at a spacing from one another.

Figure 5:
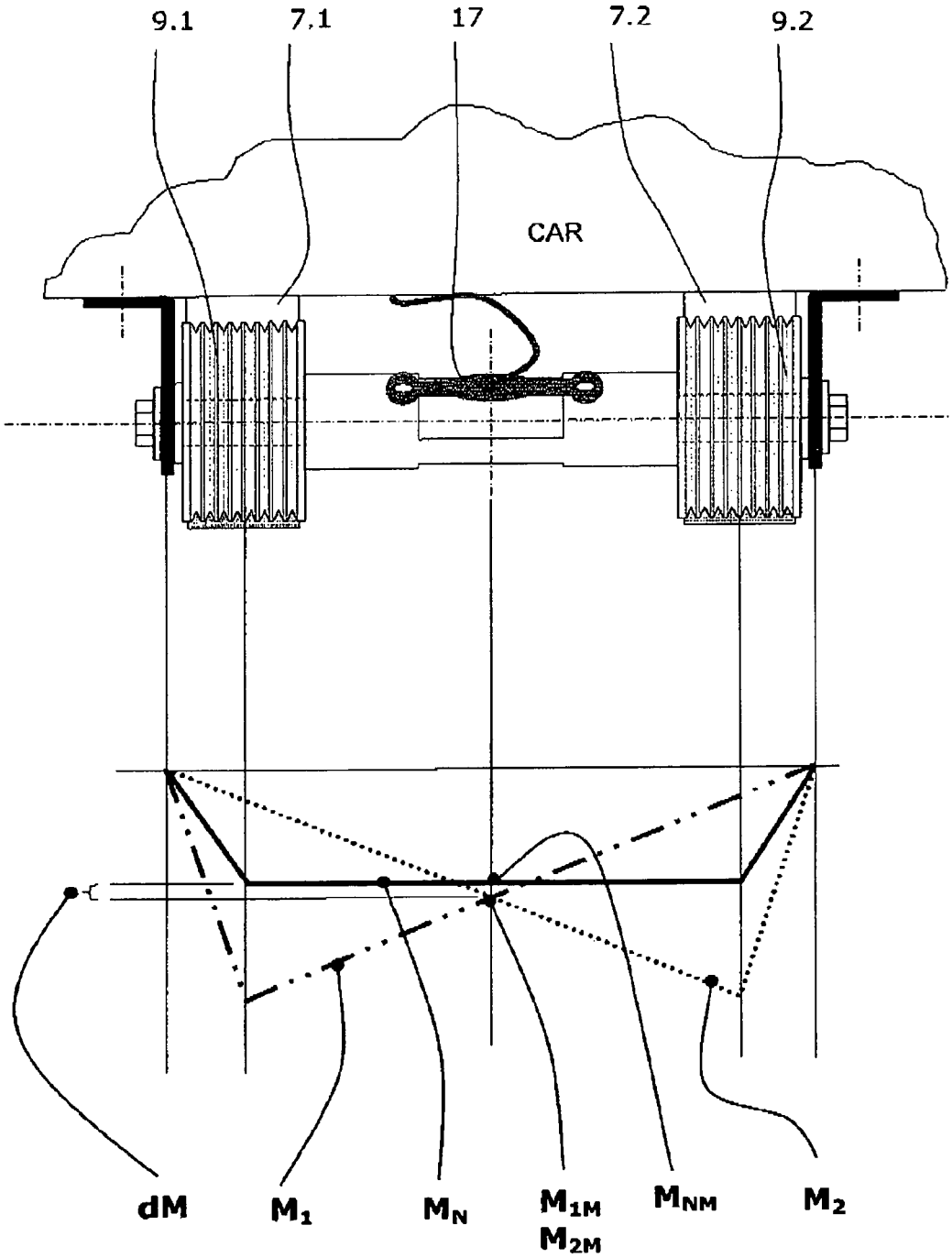
FIG. 5 shows a moment diagram of the deflecting roller unit of FIG. 3.

The symmetrical arrangement of the load sensor 17 in the center between the two deflecting rollers 9 gives the advantage, as illustrated in FIG. 5, that an asymmetrical distribution of support means forces to the two support means 7 does not have a significant effect on a measurement deviation in the load sensor 17. In the case of a normal load distribution between two support means 7.1, 7.2, a bending moment course $M_N$ in the common axle 11 results, which has a substantially constant value between the two deflecting rollers 9.1, 9.2. The load sensor 17, which is arranged in the center between the two deflecting rollers 9.1, 9.2, detects a bending deformation value which results in correspondence with a bending stress $M_{NM}$.

In the case of a different load distribution between the two support means 7.1, 7.2, which is illustrated in FIG. 5 in such a manner that the starting point is a total failure of a respective one of the support means 7.1, 7.2, a bending moment course $M_1$ results when the support means 7.2 fails and a bending moment course $M_2$ if the support means 7.1 should fail. As apparent from comparison of the bending moment courses $M_N$, $M_1$, $M_2$ the bending deformation value $M_{1M}$, $M_{2M}$ detected by the load sensor 17, which is arranged in the middle between the two deflecting rollers 9, remains unchanged in comparison with the bending deformation value $M_{NM}$. A maximum measurement deviation dM in the bending deformation value results.

Figure 6:
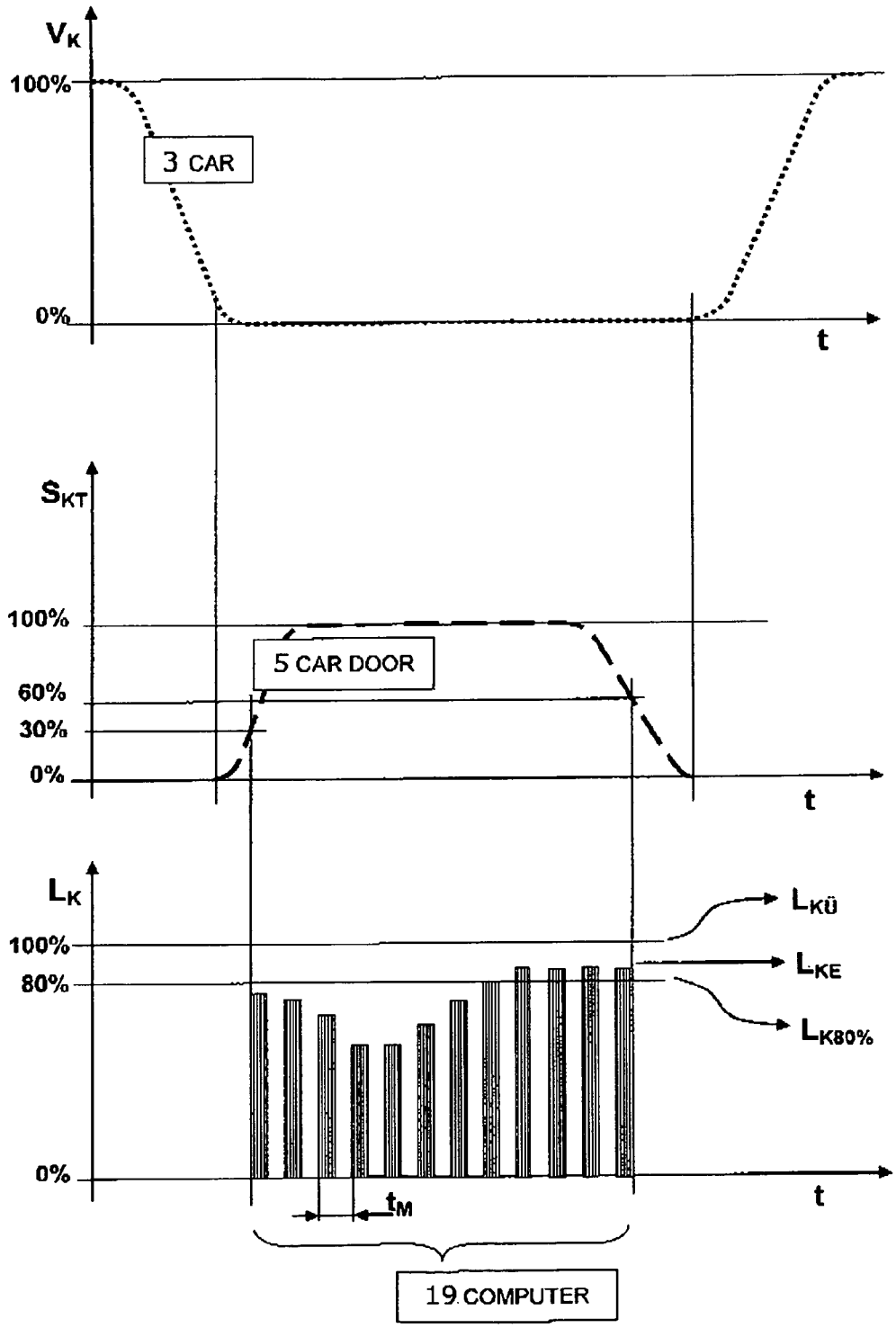
FIG. 6 shows a time sequence diagram of a load measuring process according to the present invention during a car loading process.

FIG. 6 shows a measurement process in the operating sequence of the elevator installation. The elevator car 3 approaches a stopping point at an operating speed $V_K$ of 100% and decelerates to standstill. Shortly before attaining standstill the elevator car initiates opening of the car door 5. The car door 5 begins to open and frees access to the car 3 in correspondence with an opening travel $S_{KT}$. As soon as a minimum passage of, for example, 30% or a minimum passage of, for example, 0.4 meters exists the load measuring or the load measurement computer 19 is switched on and delivers at time intervals $t_M$ a signal $L_K$, which corresponds with the effective useful load, to the elevator control 20. The elevator control can now, as illustrated in the example, recognize an 80% useful load and stop further loading by means of a warning buzzer or an information display "car full" (not illustrated) and initiate closing of the car door. As soon as the car door is now closed to such an extent that an access can no longer be effected, in the illustrated example at 60%, the load measurement computer 19 stops evaluation of the load measurement signal and the elevator control 20 uses the last measurement value $L_{KE}$ for determination of the start torque of the elevator drive. As soon as the opening travel of the car door 5 is at 0% (closed), a move-off travel of the car 3 is correspondingly initiated.

If now the elevator control signal detects an overload $L_{KÜ}$ on the basis of the load measurement signal $L_K$ a demand for reduction of the useful load is issued and a closing process of the car door would be prevented as long as an overload exists. The control can obviously provide that other criteria are defined in special operation. Thus, for example, in the case of emergency operation such as a fire alarm a higher overload limit could be permitted.

With knowledge of the present invention the elevator expert can change the desired shapes and arrangements as desired. For example, the illustrated elevator control can further evaluate the signal of the load measurement computer in that, for example, the time instant of the warning signal is defined in dependence on a speed of loading. Moreover, a corresponding deflecting roller unit with load sensor can also be arranged, for example, in the shaft or at the drive.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation comprising:

an elevator car;

a support means connected to said car for supporting said car;

two deflecting rollers, said support means partly looping around said two deflecting rollers and said two deflecting rollers being rotatably mounted on a common axle; and a load sensor arranged on said common axle between said two deflecting rollers for sensing a load in said car and generating a signal representing the sensed load.

2. The elevator installation according to claim 1 wherein said load sensor is centrally arranged between said two deflecting rollers and said load sensor measures a bending deformation of said common axle.

3. The elevator installation according to claim 1 wherein said common axle is cut away in a center region to form a rectangular cross-sectional portion oriented substantially symmetrically with respect to a longitudinal axis of said common axle and said cross-sectional portion is so oriented that a resultant deflecting roller force produced by looping-around of said deflecting rollers by said support means causes an appropriate bending deformation of said cross-sectional portion.

4. The elevator installation according to claim 1 wherein said common axle includes two outer axle sections fixedly connected together by a connecting part and said connecting part is shaped and oriented whereby a resultant deflecting roller force produced by looping-around of said deflecting rollers by said support means causes an appropriate bending deformation of said connecting part.

5. The elevator installation according to claim 1 wherein said common axle is fastened at opposite ends to said car to be substantially resilient in bending, wherein at least one of said ends has a positioning aid enabling alignment of said common axle with respect to a resultant deflecting roller force generated by the load.

6. The elevator installation according to claim 1 wherein said two deflecting rollers and said common axle are pre-assembled to form a deflecting roller unit prior to installation on said car.

7. The elevator installation according to claim 6 wherein the elevator installation includes two of said deflecting roller units and at least one said deflecting roller units includes said load sensor.

8. The elevator installation according to claim 1 wherein said load sensor includes a load measurement computer or is connected with a load measurement computer and said load measurement computer determines an effective useful load based upon the signal generated by said load sensor.

9. The elevator installation according to claim 8 wherein said load measurement computer determines an effective useful load at intervals during a period over which access to said elevator car is possible and an elevator control passes on a respective last measurement signal generated by said load measurement computer to an elevator drive for determination of a start torque or said elevator control blocks a move-off command if an overload condition is detected.

10. The elevator installation according to claim 1 wherein said load sensor is a digital sensor.

11. A deflecting roller unit for connecting a support means with an elevator car comprising:

two deflecting rollers rotatably mounted on a common axle; and a load sensor is arranged on said common axle between said two deflecting rollers and generating a signal representing a load applied to the axle.

12. A method of arranging a load sensor in an elevator installation, which elevator installation includes a car and a support means for supporting the car, comprising the steps of:

a. rotatably mounting two deflecting rollers on a common axle and attaching the common axle to the car;

b. connecting the support means to the car with the two deflecting rollers; and c. arranging a load sensor on the common axle between the two deflecting rollers, the load sensor generating a signal representing a load the car.

13. The method according to claim 12 including determining an effective useful load in the car with a load measurement computer by receiving load measurement signal from the load sensor at intervals during a period over which there is access to the elevator car and either passing a last effective useful load signal, for determination of a start torque, to an elevator drive by an elevator control or blocking a move-off command by the elevator control if an overload is detected.

* * * * *